US006135605A

United States Patent [19]

Hsu et al.

[11] Patent Number: 6,135,605

[45] Date of Patent: Oct. 24, 2000

[54] WATERPROOF FLASHLIGHT DEVICE FOR UMBRELLAS

[76] Inventors: Chia Ming Hsu, No. 105, Chang Ho Street, Ho Chi Li; Wen Shan Yeh, No. 20, Lane 323, Sec. 2, Chang Mei Road, both of Ho Mei Jen, Chang Hua Hsien, Taiwan

[21] Appl. No.: 09/391,502

[22] Filed: Sep. 8, 1999

[51] Int. Cl.[7] ..... A45B 3/02; A63B 15/02

[52] U.S. Cl. ..... 362/102; 362/276; 362/802; 362/186; 362/158

[58] Field of Search ..... 362/276, 802, 362/186, 158, 102, 208

[56] References Cited

U.S. PATENT DOCUMENTS

| | | | |
|---|---|---|---|
| 2,631,247 | 3/1953 | Shaw | 250/239 |
| 5,493,480 | 2/1996 | Huang | 362/102 |
| 5,618,100 | 4/1997 | Glynn | 362/183 |
| 5,664,874 | 9/1997 | Winterer | 362/802 |
| 5,803,574 | 9/1998 | Szaniszlo | 362/32 |

*Primary Examiner*—Sandra O'Shea
*Assistant Examiner*—Ali Alavi
*Attorney, Agent, or Firm*—Rosenberg, Klein & Lee

[57] ABSTRACT

A waterproof flashlight device for umbrellas comprises a shell made of transparent soft material, a circuit board, at least a battery, and a self-control switch. The shell has a seat installed inside. The seat is joined with a stage having a hollow chamber inside through a waterproof grommet. The circuit board is installed inside the stage. The flashlight circuit on the circuit board connects to at least a battery. The self-control switch connects the battery with the flashlight circuit. The self-control switch has two soft circuit boards. A metal ball is lapped on one of the two soft circuit boards. When the user unfolds the umbrella at night, the metal ball will contact the two soft circuit boards, and the battery will provide electricity to the flashlight circuit. The flashlight circuit will thus flash when there is no sufficient light outside.

9 Claims, 6 Drawing Sheets

WATERPROOF FLASHLIGHT DEVICE FOR UMBRELLAS

FIELD OF THE INVENTION

The present invention relates to a waterproof flashlight device for umbrellas.

BACKGROUND OF THE INVENTION

The conventional flashlight device for umbrellas has no waterproof function in design. Rainwater can permeate the junction part, resulting in short circuit of the flashlight device inside and thus unsafe usage.

One object of the present invention is to provide a waterproof device for umbrellas, which has a shell made of soft material having a seat installed inside. The seat is disposed (or screwed) at the umbrella head and joins a stage having a hollow chamber inside. The stage has a circuit board installed inside. A flashlight device on the circuit board connects to at least one battery. Rainwater can not permeate the junction part, resulting in waterproof function.

Another object of the present invention is to provide a flashlight device without need of pressing a control switch to turn on and off the battery. A self-control switch (or a gravity switch) connects the flashlight circuit with the battery. When the user unfolds the umbrella, the self-control switch forms a normally closed-circuit, letting the battery provide electricity to the flashlight circuit. The light-emitting diode (LED) can thus flash when the light outside is insufficient. When the umbrella head is netherward, the self-control switch forms a normally open-circuit, letting the battery provide no electricity to the flashlight circuit. The LED will thus go off.

Yet another object of the present invention is to provide a waterproof flashlight device which can be detached from the umbrella head to be used as a blinker.

The various objects and advantages of the present invention will be more readily understood from the following detailed description when read in conjunction with the appended drawing, in which:

DETAILED DESCRIPTION OF PREFERRED EMBODIMENT

Figure 1:
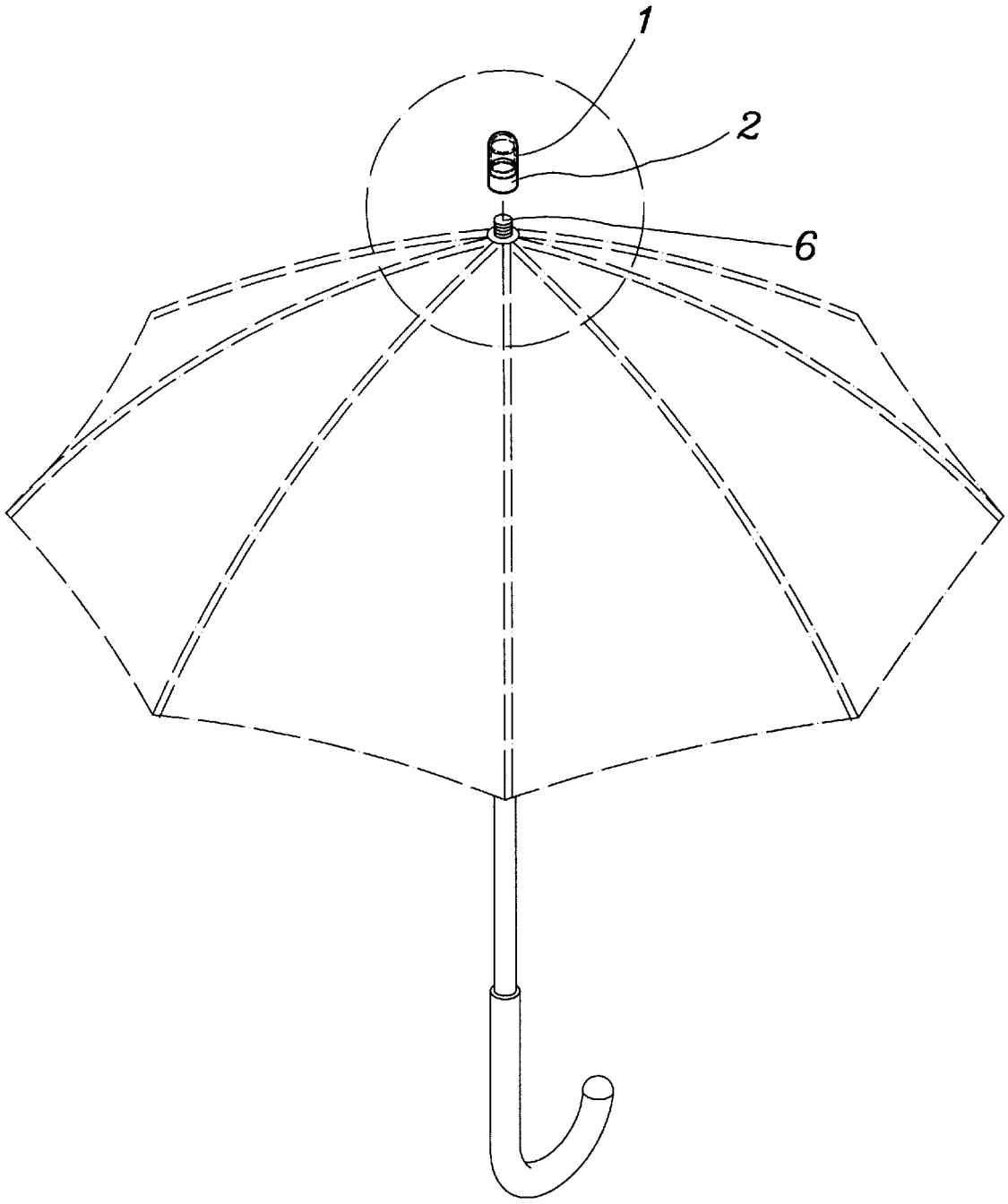
FIG. 1 is a perspective view of the waterproof flashlight device according to the present invention.
Figure 2:
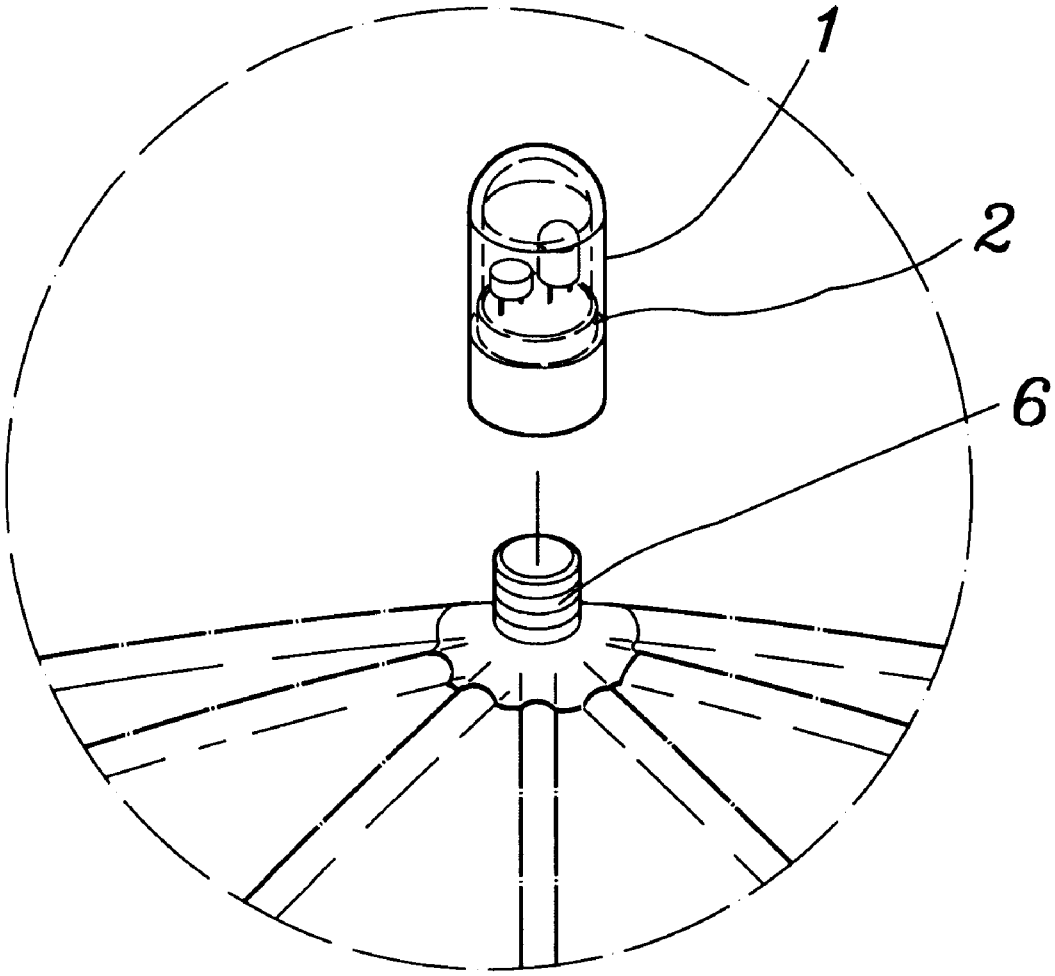
FIG. 2 is a locally enlarged perspective view of the waterproof flashlight device according to the present invention.
Figure 3:
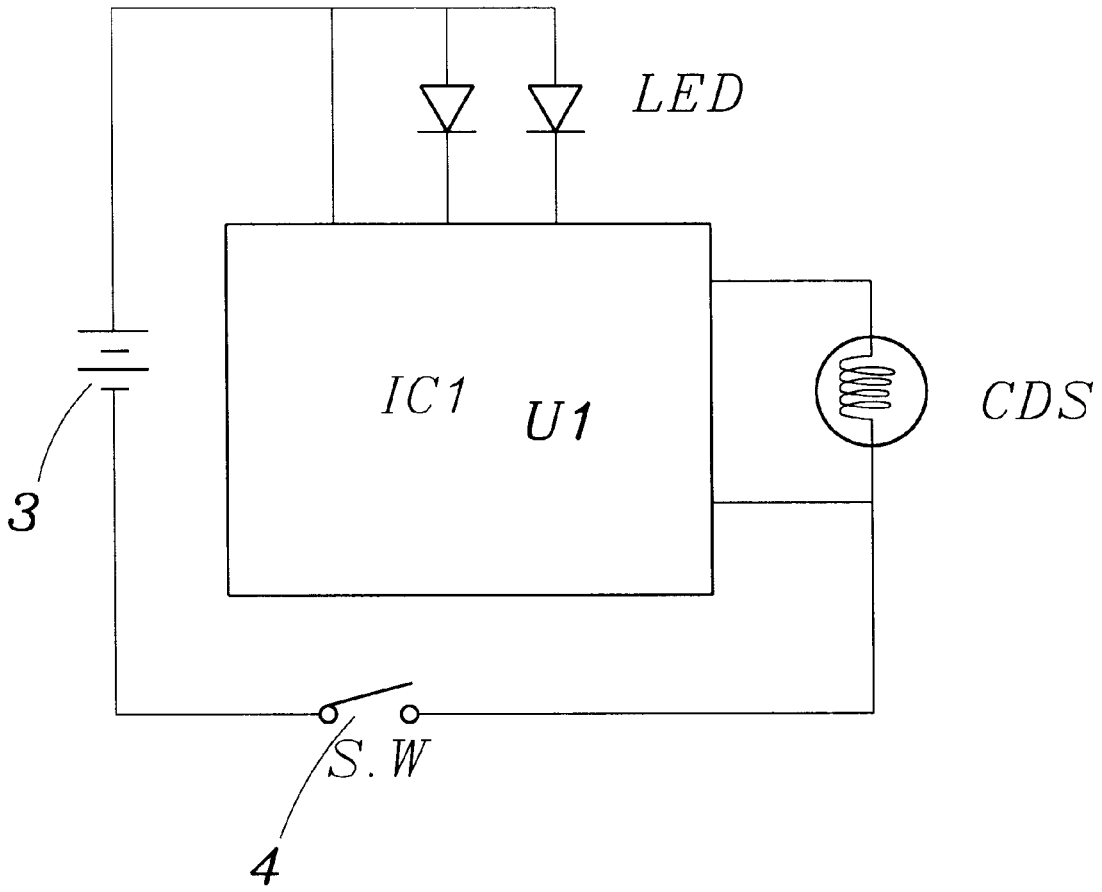
FIG. 3 is a cross section view of the waterproof flashlight device according to the present invention.
Figure 4:
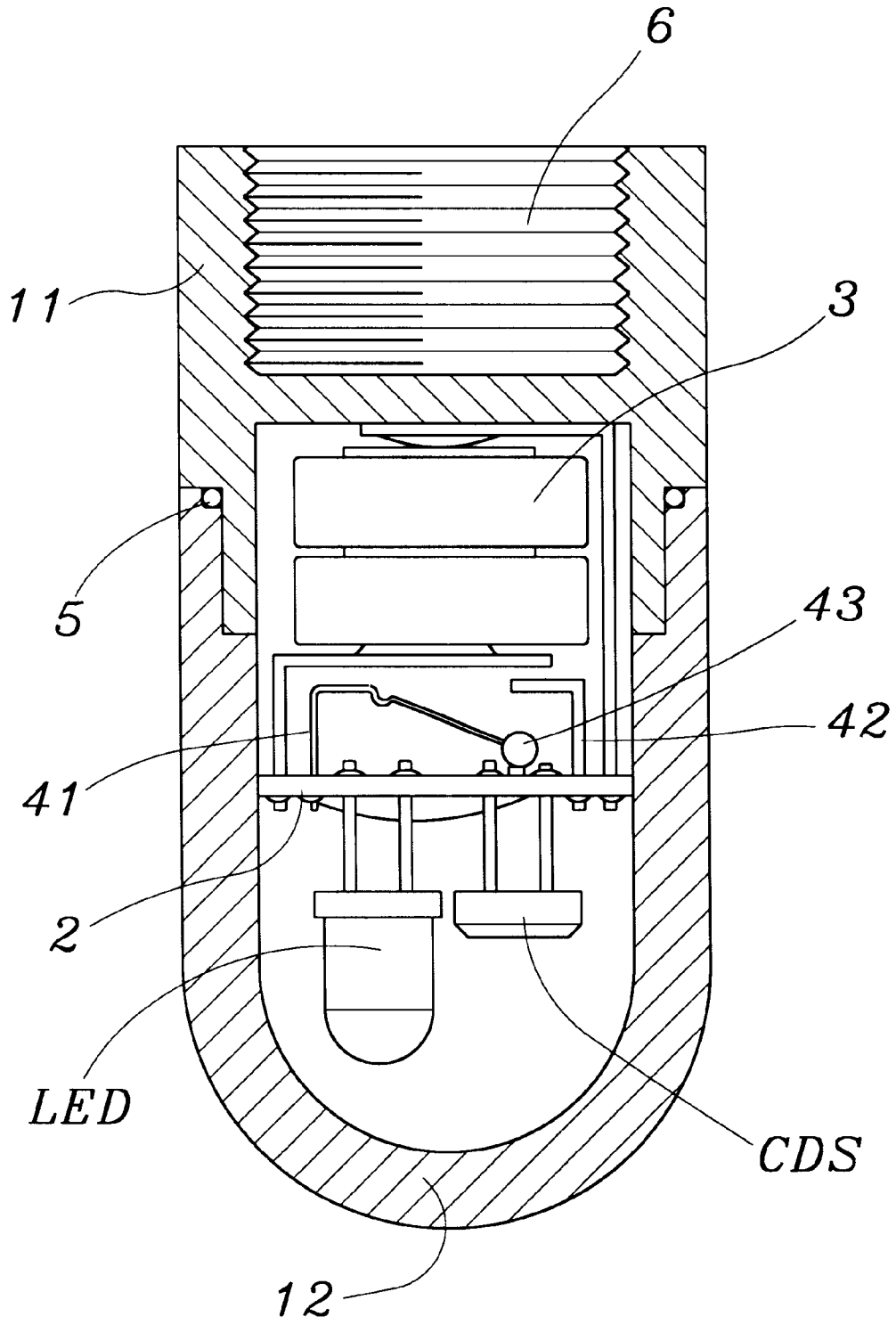
FIG. 4 is the circuit diagram of the flashlight circuit according to the present invention.
Figure 5:
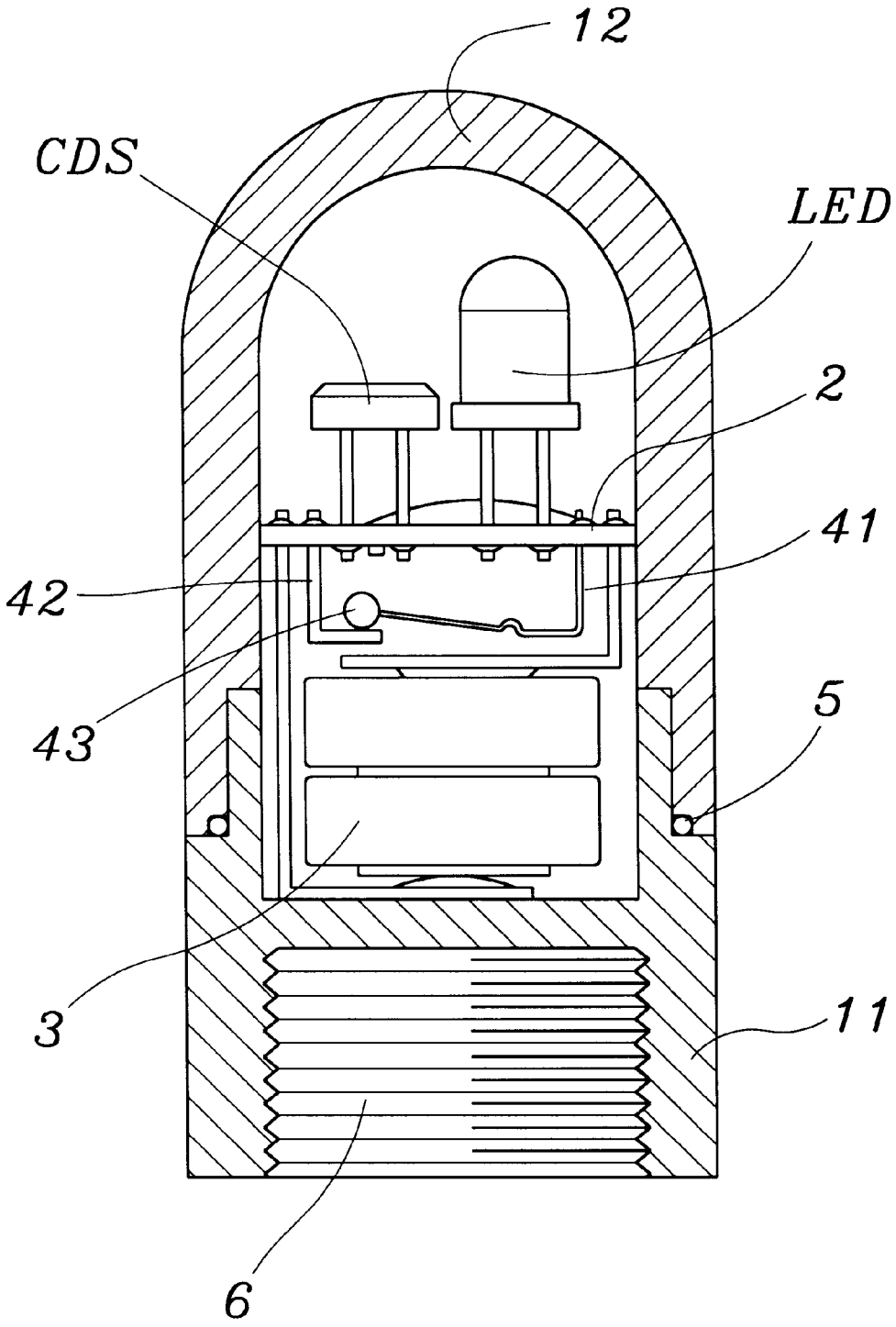
FIG. 5 is a cross section view of the waterproof flashlight device showing the normally closed-circuit of the self-control switch.
Figure 6:
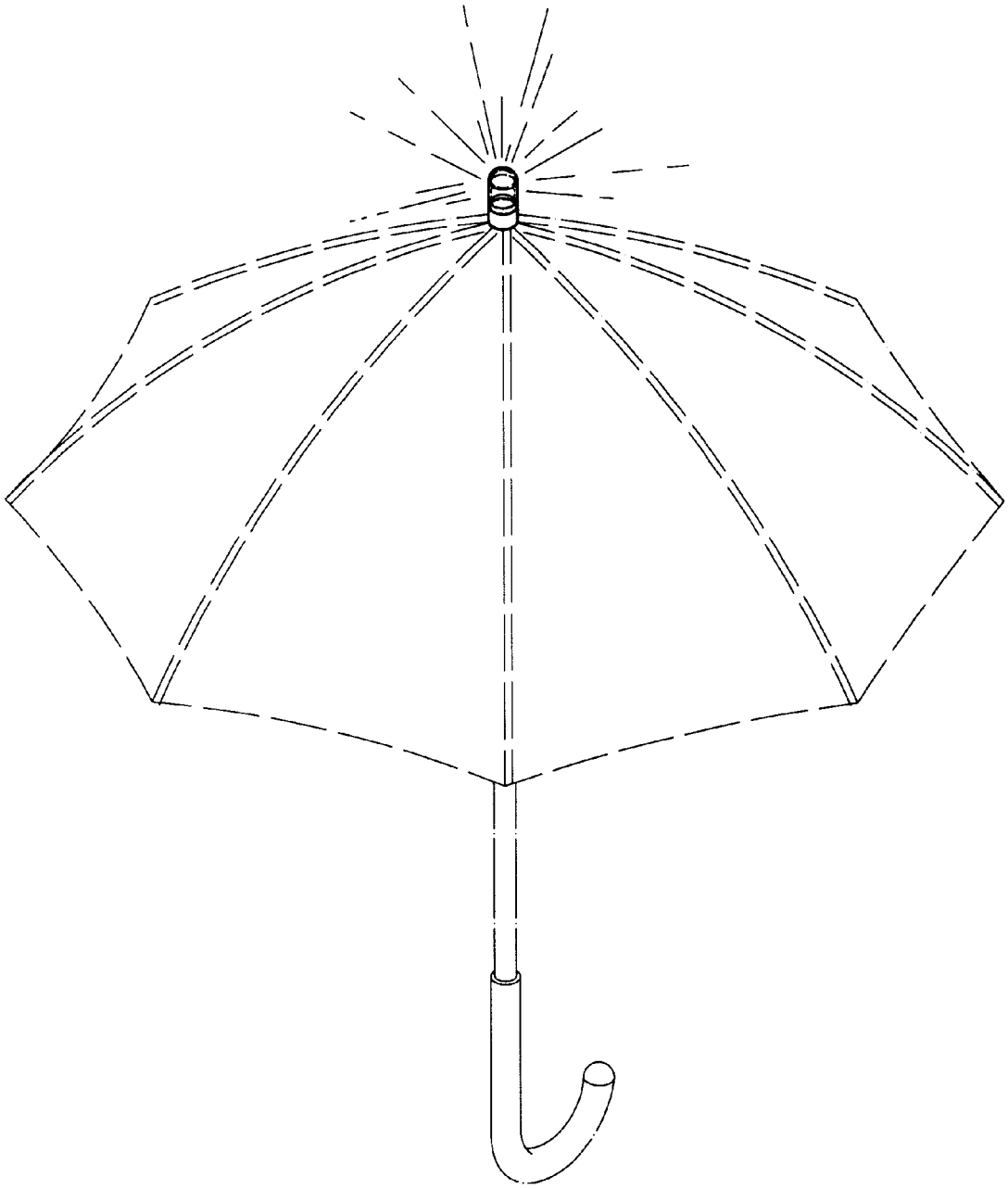
FIG. 6 is a perspective view of the waterproof flashlight device according to an embodiment of the present invention.

Please refer to FIGS. 1 to 5, the waterproof flashlight device of the present invention comprises a shell 1 made of transparent soft material, a circuit board 2, at least a battery 3, a self-control switch 4, and a waterproof grommet 5.

The shell 1 has a seat 11 installed inside. The bottom of the seat 11 is screwed the umbrella head 6 according to an embodiment of the present invention. The seat 11 is joined (screwed, locked, telescoped, or in other ways) with a stage 12 having a hollow chamber inside.

The circuit board 2 is installed inside the stage 12. The flashlight circuit on the circuit board 2 comprised an integrated-circuit (IC) control circuit U1, at least an light-emitting diode (LED), and a photovaristor CdS. The flashlight circuit connects to at least a battery.

The photovaristor CdS will activate the IC control circuit U1 to let the LED flash when it senses that there is not sufficient light outside.

The self-control switch (gravity switch) has two soft circuit boards 41 and 42. The two soft circuit boards 41 and 42 connect the battery 3 with the flashlight circuit on the circuit board 2. A metal ball 43 is lapped on the soft circuit board 41.

When the metal ball 43 contacts the two soft circuit boards 41 and 42, the self-control switch 4 will let the battery 3 provide electricity to the flashlight circuit. The photovaristor CdS of the flashlight circuit will thus activate the IC control circuit U1 to let the LED flash when it senses that there is not sufficient light outside.

When the user unfolds the umbrella at night, the self-control switch 4 will be on (normally closed-circuit), the battery will provide electricity to the flashlight circuit. The photovaristor CdS will thus activate the IC control circuit U1 to let the LED flash when it senses that there is no sufficient light outside. When the umbrella head 6 is netherward, the self-control switch 4 is off (normally open-circuit). The battery will provide no electricity to the flashlight circuit, and the LED will thus go off.

Although the present invention has been described with reference to the preferred embodiment thereof, it will be understood that the invention is not limited to the details thereof Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A waterproof flashing light device for umbrellas, comprising:

a shell formed of a transparent soft material mounted to an umbrella, said shell including a seat adapted for coupling to the umbrella and a stage joined to said seat and having a chamber formed therein;

at least one battery disposed in said chamber; and, a circuit board disposed in said chamber, said circuit board including (a) a light emitting diode electrically coupled thereto, (b) a control circuit mounted on said circuit board and electrically coupled to said at least one battery and said light emitting diode for controlling said light emitting diode to illuminate in a flashing manner, and (c) photosensor coupled to said control circuit for initiating operation thereof responsive to an ambient light level being sensed below a predetermined level.

2. The device as recited in claim 1 where said seat is coupled to a head portion of the umbrella.

3. The device as recited in claim 2 where said seat has internal threads for said coupling to the head portion of the umbrella.

4. The device as recited in claim 1 where said photo sensor is a photovaristor.

5. The device as recited in claim 4 where said circuit board further includes a gravity actuated switch coupled to said control circuit for controlling said initiation of operation of said control circuit responsive to an orientation of the umbrella.

6. A waterproof flashing light device for umbrellas, comprising:

a shell formed of a transparent soft material mounted to an umbrella, said shell including a seat adapted for coupling to the umbrella and a stage joined to said seat and having a chamber formed therein;

at least one battery disposed in said chamber; and, a circuit board disposed in said chamber, said circuit board including (a) a light emitting diode electrically coupled thereto, (b) a control circuit mounted on said circuit board and electrically coupled to said at least one battery and said light emitting diode for controlling said light emitting diode to illuminate in a flashing manner, (c) photo sensor coupled to said control circuit for initiating operation thereof responsive to an ambient light level being sensed below a predetermined level, and (d) a gravity actuated switch coupled to said control circuit for controlling said initiation of operation of said control circuit responsive to an orientation of the umbrella, wherein said light emitting diode is illuminated in a flashing manner when the umbrella is in a substantially upward orientation and ambient light levels are below said predetermined level.

7. The device as recited in claim 6 where said photo sensor is a photovaristor.

8. The device as recited in claim 6 where said seat is coupled to a head portion of the umbrella.

9. The device as recited in claim 8 where said seat has internal threads for said coupling to the head portion of the umbrella.

* * * * *